US008607998B2

(12) United States Patent
McMillen et al.

(10) Patent No.: US 8,607,998 B2
(45) Date of Patent: Dec. 17, 2013

(54) RAILWAY CAR YOKE

(75) Inventors: Richard G. McMillen, Pittsburgh, PA (US); Anthony J. Sicilia, McKees Rocks, PA (US); Kevin S. Saeler, Stoneboro, PA (US)

(73) Assignee: McConway & Torley LLC, Dallas, TX (US)

( * ) Notice: Subject to any disclaimer, the term of this patent is extended or adjusted under 35 U.S.C. 154(b) by 0 days.

(21) Appl. No.: 13/117,925

(22) Filed: May 27, 2011
(Under 37 CFR 1.47)

(65) Prior Publication Data

US 2012/0248053 A1 Oct. 4, 2012

Related U.S. Application Data

(63) Continuation of application No. PCT/US2011/030749, filed on Mar. 31, 2011.

(51) Int. Cl.
*B61G 9/00* (2006.01)

(52) U.S. Cl.
USPC ..... 213/67 R

(58) Field of Classification Search
USPC ..... 213/67 R, 67 A
See application file for complete search history.

(56) References Cited

U.S. PATENT DOCUMENTS

| | | | | |
|---|---|---|---|---|
| 1,352,151 | A | 9/1920 | Simonson | |
| 1,636,690 | A | 7/1927 | Hawkes et al. | |
| 1,951,318 | A | 3/1934 | Barrows | |
| 4,635,804 | A | 1/1987 | Hanula | |
| 5,096,076 | A | 3/1992 | Elliott et al. | |
| 5,221,015 | A | 6/1993 | Mautino et al. | |
| 5,320,229 | A | 6/1994 | Mautino et al. | |
| 5,339,970 | A | 8/1994 | Mautino et al. | |
| 5,511,676 | A | 4/1996 | Holmes | |
| 6,796,448 | B1 * | 9/2004 | Wilt et al. | 213/40 R |
| 7,926,672 | B2 | 4/2011 | Ely | |
| 2008/0197096 | A1 | 8/2008 | Ely | |
| 2011/0024379 | A1 | 2/2011 | Ely | |

FOREIGN PATENT DOCUMENTS

| | | | |
|---|---|---|---|
| CA | 2090212 | 2/1993 | B61G 9/04 |
| GB | 2178711 | 2/1987 | B61G 7/10 |
| WO | WO 2008/134079 | 11/2008 | B61G 9/10 |

OTHER PUBLICATIONS

International Search Report and Written Opinion; PCT/US2011/030749; pp. 13, Mar. 6, 2012.
International Preliminary Report on Patentability, PCT/US2011/030749; pp. 7, Oct. 10, 2013.

* cited by examiner

*Primary Examiner* — Zachary Kuhfuss
(74) *Attorney, Agent, or Firm* — Baker Botts L.L.P.

(57) ABSTRACT

A railway car yoke includes a nose end and at least two straps adjoining the nose end. At least one top strap adjoins a top portion of the nose end and at least one bottom strap adjoins a bottom portion of the nose end. The railway car yoke also includes a butt end adjoining the at least two straps such that the nose end and the butt end are separated by the at least two straps. The butt end comprises at least one concave contour along an outside surface of the butt end. The outside surface is a surface along the butt end opposite the nose end that extends from a top surface of the at least one top strap to a bottom surface of the at least one bottom strap.

17 Claims, 4 Drawing Sheets

RAILWAY CAR YOKE

CROSS REFERENCE TO RELATED APPLICATIONS

This application is a continuation of International Application No. PCT/US2011/030749 filed Mar. 31, 2011, by Richard G. McMillen et al. and entitled "Railway Car Yoke".

TECHNICAL FIELD

The present disclosure is related to railway car coupling, and more particularly to a railway car yoke.

BACKGROUND

Railway car yokes serve the purpose of forming a pocket for the draft gear and maintaining the gear in proximity to the rear end of the coupler, so that forces applied to the coupler head are dampened by the gear. In standard freight car draft arrangements, a rectangular shaped block of steel is interposed between the butt of the coupler shank and the front working-end of the draft gear. This block extends crosswise through the front end of the yoke gear pocket and is termed the front follower. The relative positions of the front follower and draft gear to the coupler butt are maintained due to the securing of the yoke to the coupler shank by a connecting key, or pin.

The yoke design is predicated on the draft gear and coupler shank end. The yoke draft gear pocket may be compatible, in length, to the gear length and travel afforded by the gear. The shape of the front end of the yoke must be suited to receive the butt end of the coupler shank with proper provision for the connection of these two items. Thus, different yokes may be used to fit with different types of coupler shank butts.

During use, significant forces are applied to the yoke as the railway car is engaged and pulled along the track. These forces can cause bending stresses in various points of the yoke. Over time these bending stresses may cause the yoke to fail.

SUMMARY

The teachings of the present disclosure relate to a railway car yoke that includes a nose end and at least two straps adjoining the nose end. At least one top strap adjoins a top portion of the nose end and at least one bottom strap adjoins a bottom portion of the nose end. The railway car yoke also includes a butt end adjoining the at least two straps such that the nose end and the butt end are separated by the at least two straps. The butt end comprises at least one concave contour along an outside surface of the butt end. The outside surface is a surface along the butt end opposite the nose end that extends from a top surface of the at least one top strap to a bottom surface of the at least one bottom strap.

Technical advantages of particular embodiments include improving the ability of the yoke to distribute the forces applied to the yoke during operation. Accordingly, bending stresses are reduced and the yoke is more resistant to failure. Another technical advantage of particular embodiments is a reduction in the weight of the yoke, without a significant corresponding weakening of the yoke.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

A more complete understanding of particular embodiments will be apparent from the detailed description taken in conjunction with the accompanying drawings in which.

DETAILED DESCRIPTION OF THE DRAWINGS

Figure 1:
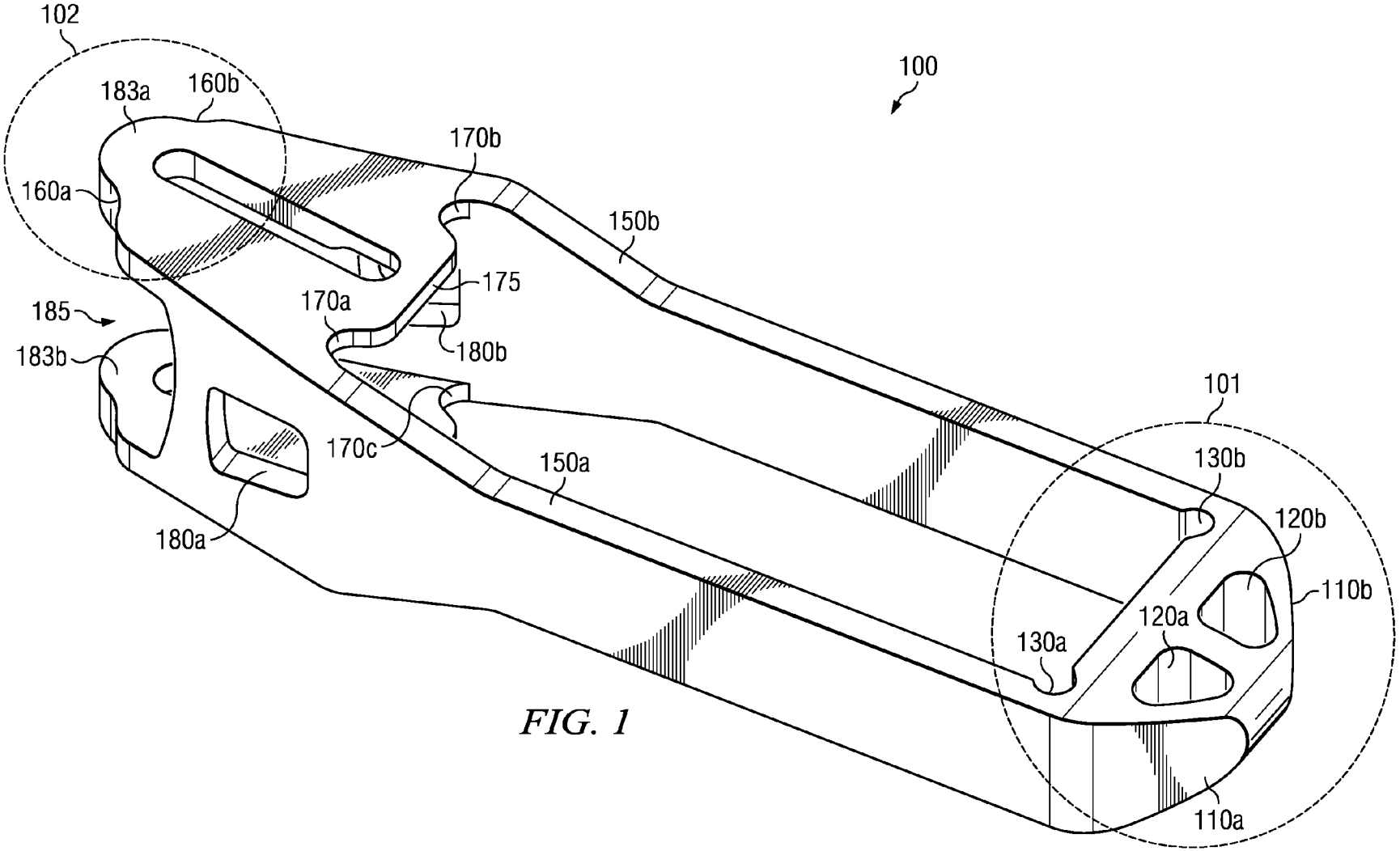
FIG. 1 is a perspective view of a yoke, in accordance with particular embodiments.

FIG. 1 is a perspective view of a yoke, in accordance with particular embodiments. Yoke 100 includes butt end 101 and nose end 102 which are coupled to one another by straps 150. The shape and features of yoke 100 may help to reduce the bending stresses at various points of yoke 100 (e.g., where straps 150 connect to butt end 101 and nose end 102) while also reducing the weight of yoke 100.

Compared to a traditional yoke, such as a conventional type E coupler yoke, yoke 100 may provide an increased life span and reduced weight. This may be achieved through the inclusion of new openings and concave contours as well as an increase in the size/radius of certain concave contours. For example, in the depicted embodiment, yoke 100 includes openings 180 and 120, and concave contours 110, 130, 160, and 170. These features may be included on a yoke that conforms to a particular coupler standard. For example, yoke 100 may be used to replace a traditional Type E coupler yoke. The details of these various elements will be described in more detail below with respect to FIGS. 2 and 3.

In particular embodiments, some of the various feature changes discussed herein may be applied to yokes other than Type E coupler yokes, such as Type F coupler yokes, rotary coupler yokes, or any other type of coupler yoke. For example, changes to butt end 101 (including interior and exterior contours) may be applied to Type E, F, rotary, or other coupler yokes.

Figure 2:
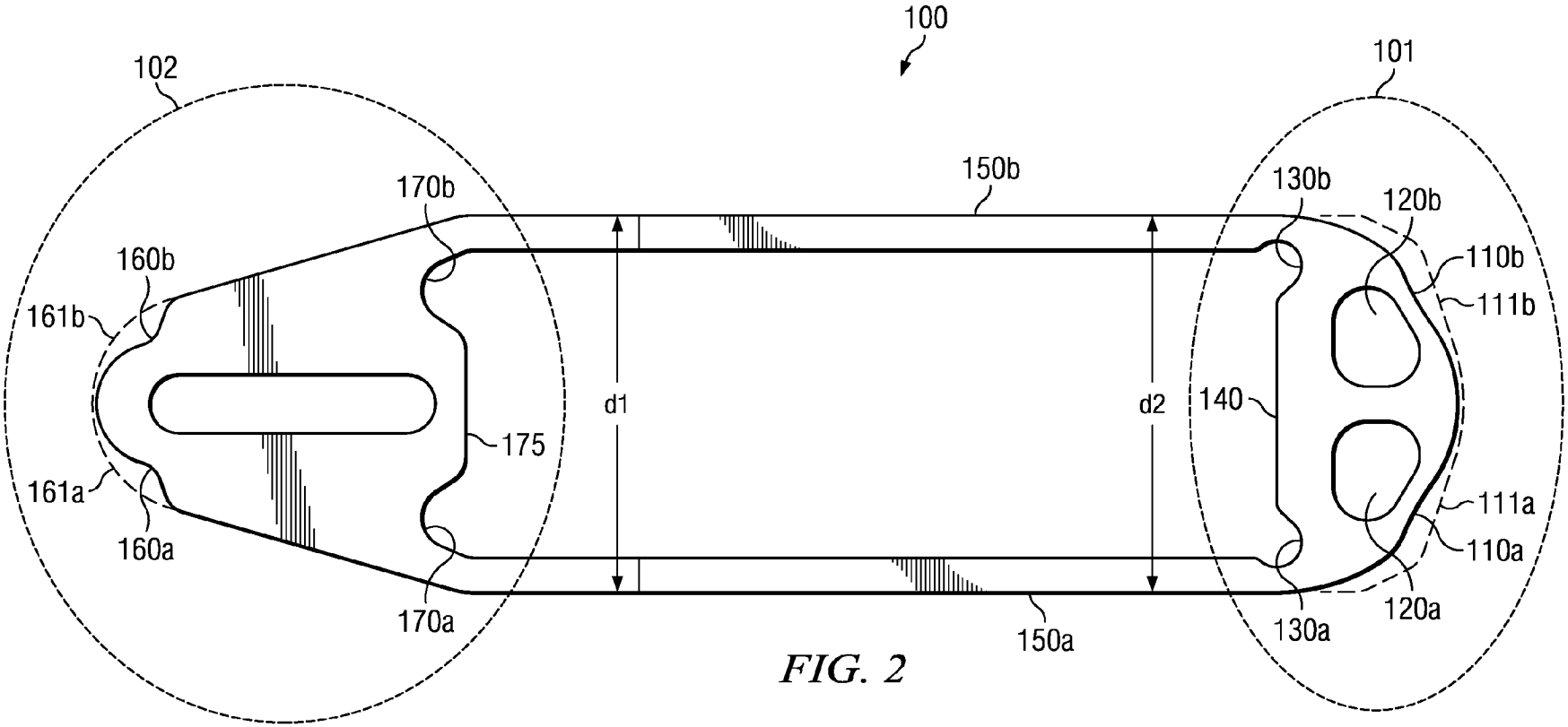
FIG. 2 is a profile view of a side of a yoke, in accordance with particular embodiments.

FIG. 2 is a profile view of a side of a yoke, in accordance with particular embodiments. While only one side of yoke 100 is depicted, the other side may comprise similar features. As can be seen in FIG. 2, concave contours 110 are located along the outside surface at the top and bottom corners of butt end 101. In some embodiments, the radius of concave contours 110 may range from approximately 4.5 inches to 5.0 inches. In particular embodiments the radius of concave contours 110 may be approximately 4.75 inches. In some embodiments, the outside surface of butt end 101, including concave contours 110, may be created by a spline. The concave shape of concave contours 110 may help better distribute forces applied to butt end 101 of yoke 100 as compared to a traditional yoke, such as a conventional type E coupler yoke. This in turn may help reduce the bending stresses experienced by yoke 100 thereby potentially extending the life expectancy of yoke 100.

Dotted lines 111 show the shape of the outer surface of the butt end of a traditional yoke (e.g., a type E coupler yoke). Compared to the butt end of a traditional yoke, represented by dotted lines 111, concave contours 110 reduce the size of butt end 101. This may help reduce the weight of yoke 100.

Openings 120 pass through the entire width (i.e., into the page) of butt end 101. In particular embodiments, openings 120 may be located between rear follower 140 and concave contours 110. In traditional yokes, the butt end comprises four cavities (two on each side) that each extend into a portion of the butt end, but do not extend all the way through. The use of openings 120 may also help to reduce the weight of yoke 100.

Figure 2A:
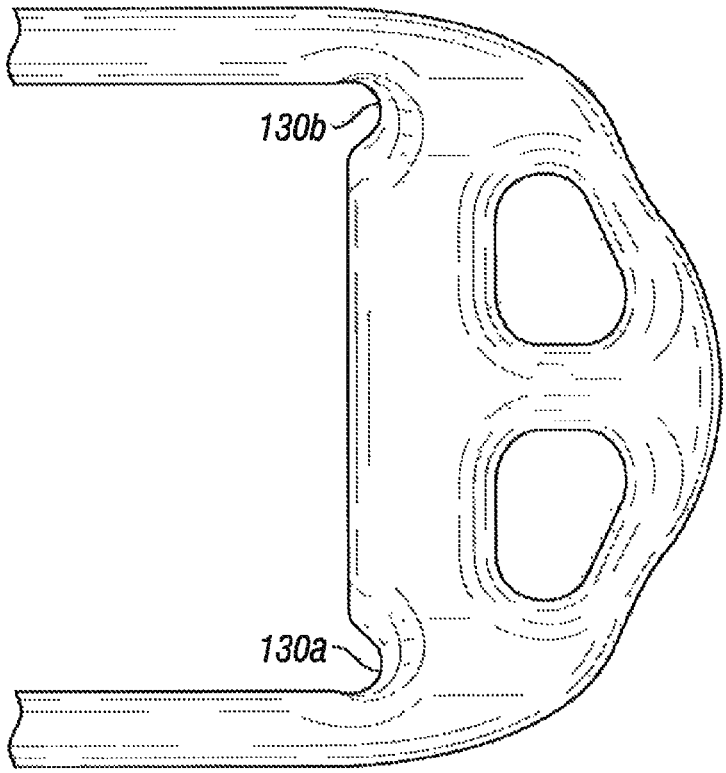
FIG. 2A is a partial view of a yoke, in accordance with particular embodiments.

Rear follower 140 makes up the inner surface of butt end 101. It also forms a portion of the boundary for a draft gear pocket (the remaining boundaries include the inner surfaces of straps 150 and front follower 175). In traditional yokes, there may exist high stress regions within the corners where rear follower 140 couples to straps 150. Particular embodiments include interior concave contours 130 to help reduce and/or distribute the amount of stress applied to the upper and lower corner areas. In some embodiments, interior concave contours 130 may be conical, as illustrated in FIG. 2A. More specifically, as interior concave contours 130 extend through the width of butt end 101 they have a conical, as opposed to a cylindrical, shape. In the conical contour embodiments, the contours may each be based on two radii. In particular embodiments, the two radii may have a range of approximately 0.25 inches to 0.75 inches for a first radii of a conical contour and approximately 1.0 inches to 1.5 inches for the second radii of the conical contour. In some embodiments the two radii of conical interior concave contours 130 may be approximately 0.5 inches and 1.25 inches. The range of radii of interior concave contours 130 may be greater than the radius of a similar area of a traditional yoke. The increased radii may help improve the distribution of forces at the respective corners compared to a traditional yoke.

As mentioned above, straps 150 may be coupled to nose end 102 and butt end 101. In traditional yokes straps are tapered so that they are closer to one another at the nose end than they are at the butt end of the yoke. However, in yoke 100 the taper of straps 150 is opposite the taper in a traditional yoke (e.g., distance d1 is greater than distance d2). For example, in particular embodiments, the distance d1 between the top surface of strap 150*b* and the bottom surface of strap 150*a* at nose end 102 may be approximately eleven and three-quarters of an inch, and the distance d2 between the top surface of strap 150*b* and the bottom surface of strap 150*a* at the butt end 101 may be approximately eleven and a half inches.

Front follower 175 makes up the inner surface of nose end 102. As mentioned above, it also forms a portion of the boundary for the draft gear pocket. In traditional yokes, there may exist high stress regions within the corners where front follower 175 couples to straps 150. Particular embodiments include interior concave contours 170 to help reduce and/or distribute the amount of stress applied to the corner areas. In particular embodiments, the radius of interior concave contours 170 may be between approximately 0.025 inches and 1.125 inches. In some embodiments the radius of interior concave contours 170 may be approximately 0.875 inches. The range of radii of interior concave contours 170 may be greater than the radius of a similar area of a traditional yoke. The increased radii may help improve the distribution of forces at the respective corners compared to a traditional yoke. In some embodiments interior concave contours 170 may be conical. More specifically, as the interior concave contours 170 extend through the width of nose end 102 they have a conical, as opposed to a cylindrical, shape. However, some embodiments may only include conical contours at contours 130.

Figure 3:
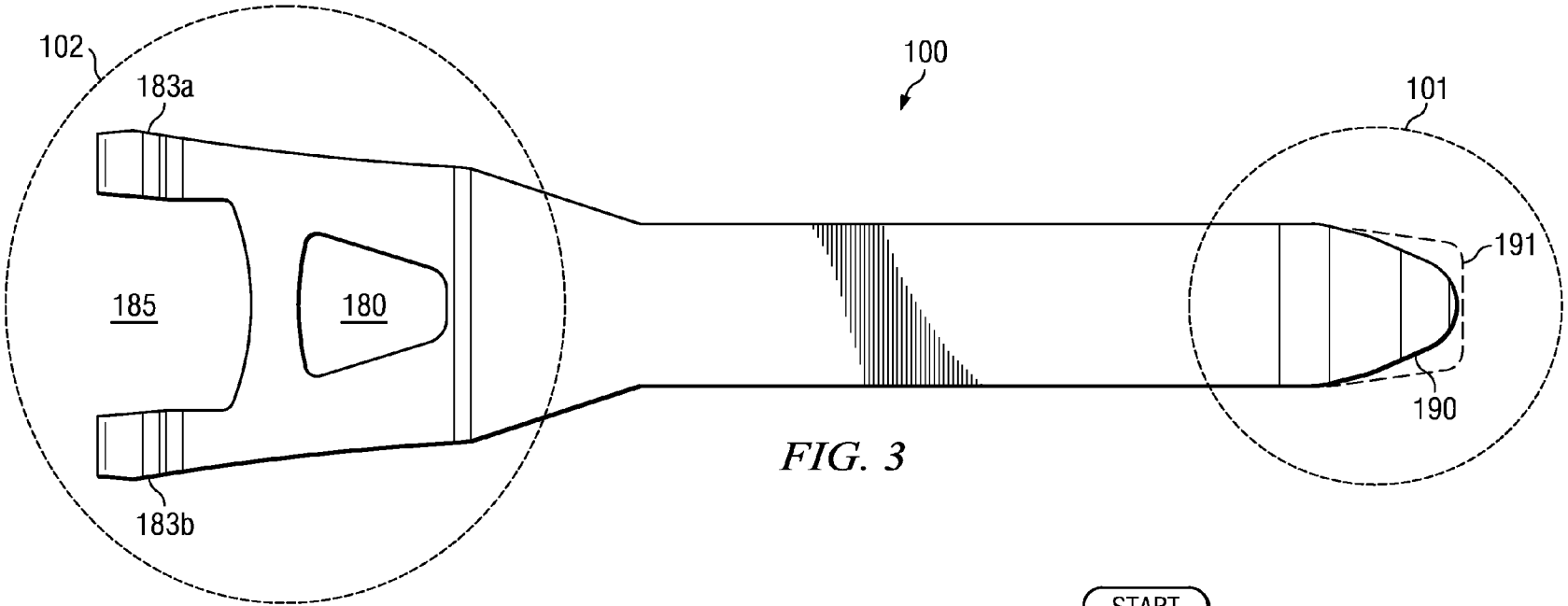
FIG. 3 is an overhead view of the top of a yoke, in accordance with particular embodiments.

Extending out on either side of nose end 102 are side extensions 183. Depending on the embodiment, side extensions 183 may comprise similar or different features. Side extensions 183 may form nose pocket 185, as seen in FIG. 3. Located along the outside surface of the top and bottom of each of side extensions 183 are concave contours 160. In some embodiments the radius of concave contours 160 may range from approximately 0.5 inches to 1.0 inches. For example, in some embodiments the radius of concave contours 160 may be approximately 0.75 inches. Concave contours 160 may help to distribute forces applied to nose end 102 of yoke 100. This in turn helps to reduce bending stresses.

Dotted lines 161 show the shape of the outer surface of a nose end of a traditional yoke. As can be seen by comparing the nose end of a traditional yoke, represented by dotted lines 161, with concave contours 160 of nose end 102 the size of nose end 102 may be reduced. This may help reduce the weight of yoke 100.

FIG. 3 is an overhead view of the top of a yoke, in accordance with particular embodiments. While FIG. 3 only depicts the top of yoke 100, similar features may be found on the bottom of yoke 100. From this overhead view it can be seen that butt end 101 comprises a rounded or elliptical profile 190. In particular embodiments, the elliptical profile may be based on an ellipse having a major radius of 5.75 inches from a center of the ellipse to a vertex of the ellipse and a minor radius of 2.5 inches from the center of the ellipse to a co-vertex of the ellipse. The major radius of such an ellipse may be substantially aligned along a center line of yoke 100 that extends from nose end 102 to the butt end 101. Dotted lines 191 show the squared profile of a traditional yoke. The reduced size of profile 190 may further reduce the weight of yoke 100 as compared to a traditional yoke.

Further weight reduction may be achieved through openings 180 located at the top and bottom surfaces of nose end 102. In a traditional yoke the areas of the nose above and below the pocket opening are solid. Typically, these areas of a yoke do not experience high levels of force. Thus, removing the material from yoke 100 to create openings 180 may allow weight reduction with minimal weakening of yoke 100 compared to a traditional yoke in which the top and bottom surfaces of nose end 102 are solid. In some embodiments, yoke 100 may have a weight of about 205 pounds, compared with a weight of about 215 pounds of a traditional yoke.

Figure 4:
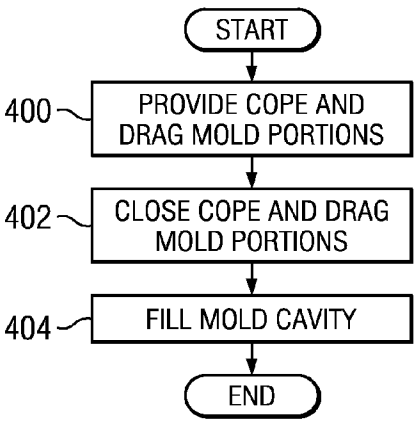
FIG. 4 is a method for manufacturing a railway car yoke, in accordance with particular embodiments.

FIG. 4 is a method for manufacturing a railway car yoke, in accordance with particular embodiments. The yoke is produced in a mold cavity within a casting box between cope and drag sections. Sand, such as green sand, is used to define the interior boundary walls of the mold cavity. The mold cavity may be formed using a pattern and may include a gating system for allowing molten alloy to enter the mold cavity. The method begins at step 400 where cope and drag mold portions are provided. The cope and drag mold portions may each include internal walls, formed of sand using a pattern or otherwise, that define at least in part surfaces of a yoke mold cavity. The mold cavity corresponds to the desired shape and configuration of a yoke to be cast using the cope and drag mold portions, such as the yokes described herein with respect to particular embodiments.

At step 402, the cope and drag mold portions are closed using any suitable machinery. At step 404, the mold cavity is at least partially filled, using any suitable machinery, with a molten alloy which solidifies to form the yoke. In some embodiments, one or more cores may be inserted in the mold cavity or coupled to each other and/or the mold cavity to form various openings or cavities of the yoke. After the mold is filled with a molten alloy, the alloy eventually cools and solidifies into a railway car yoke having one or more features described above with respect to FIGS. 1-3.

The various embodiments described above may improve a yoke's ability to distribute the forces applied thereto during operation. Accordingly, bending stresses are reduced and the yoke is more resistant to failure. This may be achieved while also reducing the weight of the yoke, compared to a traditional yoke.

Although particular embodiments and their advantages have been described in detail, it should be understood that various changes, substitutions, and alterations can be made herein without departing from the spirit and scope of the invention as defined by the appended claims.

The invention claimed is:

1. A railway car yoke, comprising:

a nose end;

at least two straps adjoining the nose end, the at least two straps comprising at least one top strap adjoining a top portion of the nose end and at least one bottom strap adjoining a bottom portion of the nose end;

a butt end adjoining the at least two straps such that the nose end and the butt end are separated by the at least two straps, wherein the butt end comprises at least one concave contour along an outside surface of the butt end, the outside surface being a surface along the butt end opposite the nose end that extends from a top surface of the at least one top strap to a bottom surface of the at least one bottom strap, the at least one concave contour extending across at least half of a width of the outside surface of the butt end from a first edge of the outside surface to a second edge of the outside surface.

2. The railway car yoke of claim 1, wherein:

the nose end, the at least two straps and the butt end enclose a draft gear pocket; and the butt end further comprises:

a rear follower that forms a boundary of the draft gear pocket, the rear follower extending from a bottom surface of the at least one top strap to a top surface of the at least one bottom strap; and at least one opening that extends through a width of the butt end between the rear follower and the outside surface of the butt end.

3. The railway car yoke of claim 2, wherein the butt end comprises two openings that extend through the width of the butt end between the rear follower and the outside surface of the butt end.

4. The railway car yoke of claim 2, wherein the rear follower comprises top and bottom interior concave contours along an inside surface enclosing the draft gear pocket, wherein:

the top interior concave contour extends the width of the butt end where the rear follower adjoins the top strap; and the bottom interior concave contour extends the width of the butt end where the rear follower adjoins the bottom strap.

5. The railway car yoke of claim 4, wherein the two interior concave contours are conical.

6. The railway car yoke of claim 1, wherein the at least two straps are tapered from the nose end to the butt end such that a distance from the top surface of the top strap to the bottom surface of the bottom strap is approximately equal to eleven and three-quarters of an inch at the nose end and eleven and a half inches at the butt end.

7. The railway car yoke of claim 1, wherein the nose end comprises an upper opening that extends through a thickness of the top of the nose end and a lower opening that extends through a thickness of the bottom of the nose end.

8. The railway car yoke, comprising:

a nose end;

at least two straps adjoining the nose end, the at least two straps comprising at least one top strap adjoining a top portion of the nose end and at least one bottom strap adjoining a bottom portion of the nose end;

a butt end adjoining the at least two straps such that the nose end and the butt end are separated by the at least two straps, wherein the butt end comprises at least one concave contour along an outside surface of the butt end, the outside surface being a surface along the butt end opposite the nose end that extends from a top surface of the at least one top strap to a bottom surface of the at least one bottom strap; wherein the butt end comprises two concave contours, the two concave contours comprising a top concave contour located along a top portion of the outside surface and a bottom concave contour located along a bottom portion of the outside surface.

9. A railway car yoke, comprising:

a nose end;

at least two straps adjoining the nose end, the at least two straps comprising at least one top strap adjoining a top portion of the nose end and at least one bottom strap adjoining a bottom portion of the nose end;

a butt end adjoining the at least two straps such that the nose end and the butt end are separated by the at least two straps, wherein the butt end comprises at least one concave contour along an outside surface of the butt end, the outside surface being a surface along the butt end opposite the nose end that extends from a top surface of the at least one top strap to a bottom surface of the at least one bottom strap; and wherein the at least two straps are tapered from the nose end to the butt end such that a distance from the top surface of the top strap to the bottom surface of the bottom strap is greater at the nose end than at the butt end.

10. A railway car yoke, comprising:

a nose end;

at least two straps adjoining the nose end, the at least two straps comprising at least one top strap adjoining a top portion of the nose end and at least one bottom strap adjoining a bottom portion of the nose end;

a butt end adjoining the at least two straps such that the nose end and the butt end are separated by the at least two straps, wherein the butt end comprises at least one concave contour along an outside surface of the butt end, the outside surface being a surface along the butt end opposite the nose end that extends from a top surface of the at least one top strap to a bottom surface of the at least one bottom strap; wherein, from an overhead view, the butt end comprises an elliptical profile.

11. The railway car yoke of claim 10, wherein the elliptical profile is based on an ellipse having a major radius of 5.75 inches from a center of the ellipse to a vertex of the ellipse and a minor radius of 2.5 inches from the center of the ellipse to a co-vertex of the ellipse, the major radius being substantially aligned along a center line of the railway car yoke extending from the nose end to the butt end.

12. A railway car yoke, comprising:

a nose end;

at least two straps adjoining the nose end, the at least two straps comprising at least one top strap adjoining a top portion of the nose end and at least one bottom strap adjoining a bottom portion of the nose end;

a butt end adjoining the at least two straps such that the nose end and the butt end are separated by the at least two straps, wherein the butt end comprises at least one concave contour along an outside surface of the butt end, the outside surface being a surface along the butt end opposite the nose end that extends from a top surface of the at least one top strap to a bottom surface of the at least one bottom strap; wherein the nose end comprises at least two side extensions separated from one another by a nose pocket, wherein at least one side extension of the at least two side extensions comprises at least one concave contour adjacent a nose portion of the at least one side extension along an outside surface of the at least one side extension.

13. The railway car yoke of claim 12, wherein the at least one extension comprises an upper concave contour along the outside surface of the at least one extension and a lower concave contour along the outside surface of the at least one extension, wherein the upper concave contour has a radius of 0.75 inches and is above a center line of the railway car yoke that extends from the nose end to the butt end, and wherein the lower concave contour has a radius of 0.75 inches and is below the center line.

14. A method for manufacturing a railway car yoke, comprising:

providing one or more railway car yoke mold portions that when filled with a molten alloy are configured to create:

a nose end adjoining at least two straps, the at least two straps comprising at least one top strap adjoining a top portion of the nose end and at least one bottom strap adjoining a bottom portion of the nose end; and a butt end coupled to the at least two straps such that the nose end and the butt end are separated by the at least two straps, wherein the butt end comprises at least one concave contour along an outside surface of the butt end, the outside surface being a surface along the butt end opposite the nose end that extends from a top surface of the at least one top strap to a bottom surface of the at least one bottom strap, the at least one concave contour extending across at least half of a width of the outside surface of the butt end from a first edge of the outside surface to a second edge of the outside surface; and at least partially filling the mold with a molten alloy, the molten alloy solidifying after filling to form the railway car yoke.

15. The method of claim 14, wherein the railway car yoke mold portions are further configured to create:

at least an upper opening through an upper surface of the nose end; and at least a lower opening through a lower surface of the nose end.

16. The method of claim 14, wherein the railway car yoke mold portions are further configured to create at least two openings that extend through a width of the butt end.

17. A method for manufacturing a railway car yoke, comprising:

providing one or more railway car yoke mold portions that when filled with a molten alloy are configured to create:

a nose end adjoining at least two straps, the at least two straps comprising at least one top strap adjoining a top portion of the nose end and at least one bottom strap adjoining a bottom portion of the nose end; and a butt end coupled to the at least two straps such that the nose end and the butt end are separated by the at least two straps, wherein the butt end comprises at least one concave contour along an outside surface of the butt end, the outside surface being a surface along the butt end opposite the nose end that extends from a top surface of the at least one top strap to a bottom surface of the at least one bottom strap; wherein the railway car yoke mold portions are further configured to create at least two side extensions in the nose end, the at least two side extensions separated from one another by a nose pocket, wherein at least one side extension of the at least two side extensions comprises at least one concave contour adjacent a nose portion of the at least one side extension along an outside surface of the at least one side extension.

* * * * *